United States Patent [19]

Shinohara et al.

[11] Patent Number: 4,658,892

[45] Date of Patent: Apr. 21, 1987

[54] HEAT-TRANSFER TUBES WITH GROOVED INNER SURFACE

[75] Inventors: Yoshihiro Shinohara; Kiyoshi Oizumi; Yasuhiko Itoh; Makoto Hori, all of Tsuchiura, Japan

[73] Assignee: Hitachi Cable, Ltd., Tokyo, Japan

[21] Appl. No.: 684,622

[22] Filed: Dec. 21, 1984

[30] Foreign Application Priority Data

Dec. 28, 1983 [JP] Japan ..... 58-252191

[51] Int. Cl.[4] ..... F28F 1/40

[52] U.S. Cl. ..... 165/133; 165/184

[58] Field of Search ..... 165/133, 184

[56] References Cited

U.S. PATENT DOCUMENTS

| | | | |
|---|---|---|---|
| 2,279,548 | 4/1942 | Bailey | 165/133 X |
| 3,779,312 | 12/1973 | Withers, Jr. et al. | 165/184 |
| 4,044,797 | 8/1977 | Fujie et al. | 165/184 X |
| 4,118,944 | 10/1978 | Lord et al. | 165/133 X |

FOREIGN PATENT DOCUMENTS

| | | | |
|---|---|---|---|
| 0038663 | 3/1977 | Japan | 165/133 |
| 0125563 | 9/1979 | Japan | 165/133 |
| 0116765 | 9/1979 | Japan | 165/133 |
| 0113998 | 9/1981 | Japan | 165/133 |
| 0026394 | 2/1982 | Japan | 165/133 |
| 0058088 | 4/1982 | Japan | 165/133 |
| 0058094 | 4/1982 | Japan | 165/133 |
| 0150799 | 9/1982 | Japan | 165/133 |

*Primary Examiner*—William R. Cline
*Assistant Examiner*—Randolph A. Smith
*Attorney, Agent, or Firm*—Aaron B. Karas

[57] ABSTRACT

A heat-transfer tube with a grooved inner surface adapted to phase-transition for fluid flowing inside the tube disposed in a heat exchanger is disclosed. This tube can achieve the reduction in the weight per unit length, improvements in workability and characteristics of the tube by limiting the cross-sectional area of respective grooved section and the shape of the ridge defining the grooved section.

3 Claims, 22 Drawing Figures

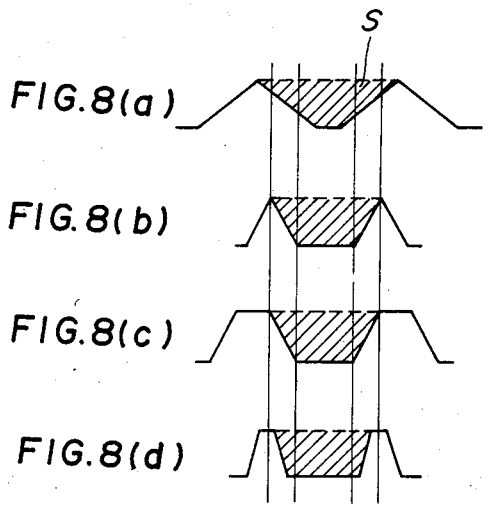
FIG. 9
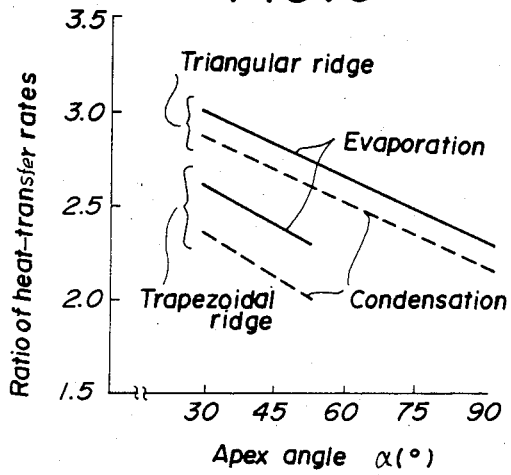

HEAT-TRANSFER TUBES WITH GROOVED INNER SURFACE

BACKGROUND OF THE INVENTION

1. Field of the Invention

The present invention relates to a heat-transfer tube with a grooved inner surface and, more particularly, to an improved inner surface grooved heat-transfer tube adapted to phase-transition of fluid flowing inside the tube disposed in a heat exchanger such as an air conditioner, refrigerator, boiler, etc.

The inner surface grooved heat-transfer tube (hereinafter called "inner surface grooved tube") has a number of spiral grooves on an inner surface of a metal tube such as a copper tube or the like, as shown in FIG. 1.

While this type of conventional inner surface grooved tubes improved by limiting the depth, shape and helix angle of the grooves, etc. have been disclosed, they do not sufficiently meet the requirements of users. The maximal reason for it is due to the low ratio of heat-transfer characteristic to manufacturing cost of the tube. That is, because the inner surface grooved tube has an inner surface of fine and irregular structure, it is difficult to provide the stable quality to the tube unless utilizing a rolling process. However, the rolling process has the limitation in production speed based on the revolution rate of a motor and the like, in other words, the limitation of manufacturing cost. On the other hand, a groove free tube can be made by a high speed drawing process. Therefore, considering the conventional inner surface grooved tube based on the ratio of the heat-transfer characteristic to the manufacturing cost, it is not easy to provide the switchover merit of the groove free tube to the grooved tube.

The configurations or shapes of the conventional typical inner surface grooved tubes are shown in FIGS. 2(*a*) and 2(*b*). There conventional grooved tubes have a low ratio of the characteristics to the manufacturing cost due to the following two reasons:

(1) It is well known that the characteristic or performance is proportional to the depth (Hf) of the grooves. The limit which the pressure loss in the grooved tube increases sharply, compared with the groove free tube exists in the vicinity of 0.02 to 0.03 (this value is represented by the ratio of the depth (Hf) of the groove to the inside diameter (Di) of the tube). The conventional grooved tube has nevertheless a value, Hf/Di, of less than about 0.018 and therefore, the groove depth of the conventional tube does not reach the above mentioned optimum limit. This is also attributable to the reasons that the increase of the groove depth in the conventional tube is related to the weight per unit length of the tube and thus, a higher cost.

(2) The factors affecting the characteristics of the tube are the shapes of groove and ridge formed on the inner surface. The conventional product shown in FIG. 2 (*a*) has insufficient characteristics because the cross-sectional area (S) of the grooved section is small and the helix angle ($\alpha$) of the ridge is large. Although the cross-sectional area (S) of the product shown in FIG. 2(*b*) is larger than that of 2(*a*), it has insufficient characteristics due to its trapezoidal ridge.

SUMMARY OF THE INVENTION

Accordingly, it is an object of the present invention to provide an inner surface grooved heat-transfer tube having a high heat-transfer rate.

It is another object to provide an inner surface grooved heat-transfer tube having a relatively low weight per unit length thereof.

It is still another object to provide an inner surface grooved heat-transfer tube which can easily be produced.

Briefly, such an inner surface grooved tube comprises a number of spiral grooves formed on the inner surface of the tube. Each of such grooves has the ratio (Hf/Di) of the depth(Hf) of the groove to the inside diameter (Di) of the tube being 0.02 to 0.03; the helix angle of the groove to an axis of the tube being 7° to 30°; the ratio (S/Hf) of the cross-sectional area (S) of respective grooved section to the depth (Hf) ranging from 0.15 to 0.40; and the apex angle (L) in cross-section of a ridge located between the respective grooves ranging from 30° to 60°.

The features of the present invention comprises providing relatively deeper grooves on the inner surface of the tube within the range which the pressure loss of fluid inside of grooved tube is not substantially increased; limiting the cross-sectional area of respective grooved section by considering the thickness of liquid film and the inner surface area of the tube; and defining the shape of the ridge located between respective grooves by overall considering the inner surface area, the weight per unit length of the tube, and the workability of the tube. Still other objects, features, and attendant advantages of the present invention will become apparent to those skilled in the art from a reading of the following detailed description of the preferred embodiments constructed in accordance therewith, taken in conjunction with the accompanying drawings.

DESCRIPTION OF THE PREFERRED DRAWINGS

FIGS. 1(*a*) and 1(*b*) are schematic cross-sectional and longitudinal sectional views of an inner surface grooved tube, respectively;

FIGS. 2(*a*), 2(*b*) and 2(*c*) are enlarged cross-sectional views of conventional products each showing the symbols for respective portions or their sizes;

Figure 7A:
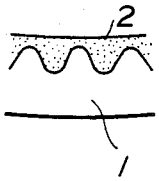
Figure 7B:
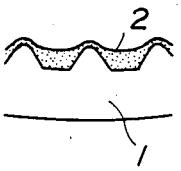
Figure 7C:
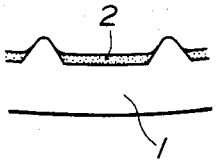
Figure 10:
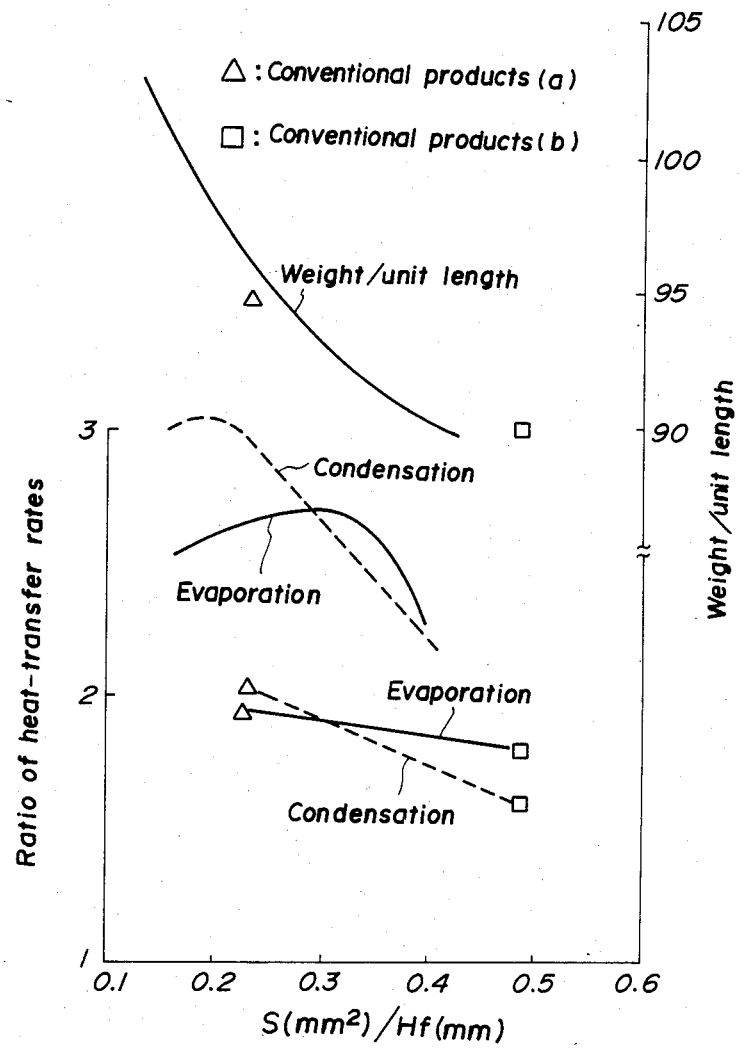

FIG. 6(*a*) and 6(*b*) is a schematic view of flow of fluid inside the tube, respectively;

FIGS. 7(*a*), 7(*b*) and 7(*c*) are schematic cross-sectional views of the relationship between the size of groove and the thickness of liquid film;

FIGS. 8(*a*)–8(*d*) are schematic cross-sectional views each showing the relation between dimensions of grooves and ridges;

FIG. 9 is a graph indicating the relation between the apex angle of groove and the heat-transfer characteristics of the tube formed in accordance with the present invention;

FIG. 10 is a graph indicating the relations between the cross-sectional area of groove and the heat-transfer characteristics or the weight per unit length of the tube formed in accordance with the present invention;

FIGS. 11(*a*)–(*c*) are graphs indicating the relations of cross-sectional area of groove and the heat-transfer characteristics or the weight per unit length of the tube formed in accordance with the present invention, and its merit compared with a conventional product.

DESCRIPTION OF THE PREFERRED EMBODIMENTS

Figure 3:
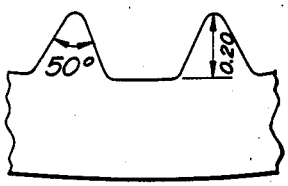
FIG. 3 is an enlarged partially cross-sectional view of an inner surface grooved tube formed in accordance with the present invention.

Referring to FIG. 3, there is shown the enlarged partially cross-sectional view of an inner surface grooved tube formed in accordance with the present invention. In this embodiment, a heat-transfer copper tube has an outside diameter (O.D.) of 9.52 mm, and an effective wall thickness of 0.30 mm. The grooves are formed on the inner surface of the copper tube so that sixty triangular ridges are provided on the inner surface at regular intervals with a helix angle ($\beta$) of 18° to an axis of the tube.

The reasons for numerical limitations in the present invention will be described below, compared with conventional products.

All of the data described hereinafter were obtained using Freon R-22 as a fluid flowing inside the tube, a vapor pressure of 4 kg/cm$^2$ on gauge, and average drying degree of 0.6, a heat flux of 10 Kw/m$^2$, a refrigerant flow rate of 200 kg/m$^2$S, a condensation pressure of 14.6 kg/cm$^2$S, an inlet superheating temperature of 50° C., and an outlet supercooling temperature of 5° C. The inner surface area of the tube was calculated on the basis of the minimum inside diameter of the tube.

First, the effect of the depth of grooves formed on the inner surface of a heat transfer tube on the characteristics of the tube will be described below.

Figure 4:
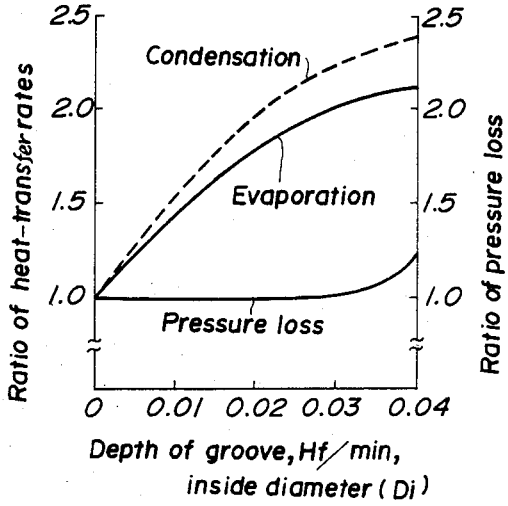
FIG. 4 is a graph showing the relations between the depth of groove and the heat-transfer rate or the pressure loss.

Using a general inner surface grooved copper tube having an outside diameter of 9.52 mm, an inner diameter of 8.52 mm and a helix angle ($\beta$) of 18°, the ratio of the depth of groove (Hf) to the minimum inner diameter (Di) of the tube is plotted as abscissa and the ratio of best transfer rate, or the pressure loss of fluid inside the grooved tube to that of a groove free, control copper tube as ordinate in FIG. 4. As shown in FIG. 4, the ratio of the heat transfer rate increases with increasing depth of groove (Hf), but the rate of the increase lowers from the vicinity of 0.02–0.03 (Hf/Di). Similarly, the pressure loss rises from the vicinity of 0.03. That is, the pressure loss of the inner surface grooved tube makes no great difference up to about 0.03 (Hf/Di) from that of the groove free tube, but it rises abruptly from this point. Therefore, in selecting as high efficient range as possible within the range in which the pressure loss of the grooved tube makes no great difference from that of the no-grooved tube, one should select a ratio of Hf/Di ranging from 0.02 to 0.03.

Figure 5:
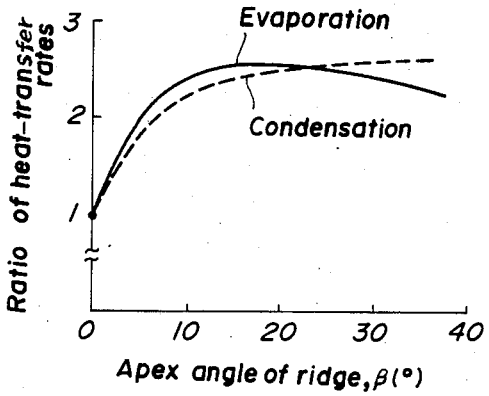
FIG. 5 is a graph showing the relations between the helix angle of groove and the heat-transfer rate.

Next, the effect of the helix angle ($\beta$) of the grooves to an axis of the inner surface grooved tube on the characteristics of the tube will be described. Referring to FIG. 5, using an inner surface grooved copper tube having an outside diameter of 9.52 mm, an inner diameter of 8.52 mm and a groove depth of 0.22 mm, the helix angle ($\beta$) to the tube axis is plotted as abscissa and the ratio of heat-transfer rate of the grooved tube to that of a grooved free, control copper tube as ordinate. As shown in FIG. 4, the ratio of the heat-transfer rate has a slight peak in the vicinity of 7°–20° helix angle upon heat-transfer with evaporation of fluid, while it slowly increses with increasing the helix angle ($\beta$) upon heat-transfer with condensation of fluid. However, an increase in the helix angle ($\beta$) of the grooves results in poor workability upon making of the grooved tube. Therefore, as an optimum helix angle ($\beta$), it is preferred to select the value ranging about from 7° to 30° for both evaporation and condensation. The heat-transfer characteristics make no great difference within this range of helix angle.

Next, considering the effects of the cross-sectional area (S) of the grooves on the heat-transfer characteristics, they include (1) the effect of stirring the fluid due to unevenness of the inner surface; (2) the effect of increase in inner surface area; and (3) the effect of variation in liquid film in the uneven portion. With respect to the stirring effect, there is no doubt that the depth of grooves (Hf) is dominant and the larger this is, the more this contributes to improvement in the heat-transfer characteristics. However, this closely relates to the effect of variation in liquid film. That is, when the fluid such as refrigerant flows at the velocity higher than a definite one, the liquid runs up in the spiral grooves due to a capillary action of the fine grooves and a drag force is caused by the velocity of the liquid and is liable to become a so-called annular flow to wet all of the inner periphery of the tube. This state is shown in FIGS. 6(*a*) and 6(*b*). FIG. 6(*a*) shows the state of a groove free tube in which the upper dried portion does not contribute to evaporation of liquid. FIG. 6(*b*) shows the state of a grooved tube in which the evaporation is enhanced by the entire inner periphery of the tube. However, even in such grooved tubes 1, when the cross-sectional area of the grooved section differs from one another and a total amount of liquid is constant, the thickness of liquid film differs from one another in its state as shown in FIG. 7. That is, in the tube (c) having a large cross-sectional area of the grooved section, the liquid film 2 is too thin, so that a tip of ridge projects from the film and thus does not bring about evaporation. On the other hand, in the tube (a) having a small cross-sectional area of the grooved section, the liquid film 2 is too thick, so that thermal resistance between a gas fluid and the tube wall increase .resulting in poor heat-transfer characteristic. Therefore, in the tube (b) having and optimum cross-sectional area of the grooved section, the entire wall surface is covered with the liquid film as thin as possible. In this case, if the forms of the ridges separated by the grooves are the same, the inner surface area of the tube 1 is inversely proportional to the cross-sectional area of the grooves. Thus, considering the heat-transfer characteristics from this inner surface area, the tube (c) is inferior to the tube (b) and the tube (a) is superior to the tube (b). Therefore, it is contemplated that the overall optimum cross-sectional area S (exactly, S/Hf) exists between the area (a) and the case (b) in FIG. 7.

FIG.8 shows the example in which the sectional shape of the ridge is varied at a constant, optimum sectional area (S) of the grooved section. In this FIG. 8, the sectional shape (a) has a larger apex angle ($\alpha$) of the ridge than that of the shape (b), and thus the former is superior to the latter in workability of the tube. However, the former (a) has a larger sectional area of the ridge than that of the latter (b), and thus this tends to increase the weight per unit length of the tube and to decrease the total inner surface area of the tube, resulting in poor heat-transfer characteristics. Similarly, the sectional shape (c) having the trapezoidal ridge tends to increase the weight per unit length of the tube and to decrease the total inner surface area of the tube. On the other hand, the sectional shape (c) having a narrow apex angle ($\alpha$) of the ridge tends to increase the total inner surface area without increase of the weight per unit length of the tube. However, the very narrow apex angle of the ridge results in a substantial raise in manufacturing cost of the tube due to its poor workability.

These qualitative effects of the shapes of the groove and ridge on the heat-transfer characteristic or performance are shown by data in FIG. 9–11.

FIG. 9 shows the relations between the shape or apex angle ($\alpha$) of the ridge, and the ratio of the heat-transfer rate of the grooved tube to that of a groove free, control copper tube using the inner surface grooved copper tube having an outside diameter of 9.52 mm, an inside diameter of 8.52 mm, a groove depth of 0.20 mm, a helix angle ($\beta$) of 18°, and a groove number of 60. As shown in FIG. 9, the narrower the apex angle of the ridge is, the higher the heat-transfer characteristics are in both evaporation and condensation, and the triangular ridge (B) is superior to the trapezoidal ridge (A) in the characteristic. However, the narrower apex angle ($\alpha$) results in poor workability of the tube to cause increase in manufacturing cost, and it is therefore preferred to employ an apex angle ($\alpha$) of 30°–60° practically.

FIG.10 shows the relations between the ratio of the cross-sectional area (S) of the grooved section to the depth of grooved (Hf), and the heat-transfer characteristic (the ratio of the heat-transfer rate of the grooved tube to that of a groove free, control copper tube), or the weight per unit length of the grooved tube, using the inner surface grooved copper tube having an outside diameter of 9.52 mm, a bottom wall thickness (Tw) of 0.30 mm, a groove depth (Hf) of 0.20 mm, a groove helix angle ($\beta$) of 18°, and a ridge apex angle ($\alpha$) of 50°. According to FIG. 10, the heat-transfer characteristic with evaporation increase slowly with increasing the value of S/Hf, indicates a peak at the vicinity of 0.3 (S/Hf) and lowers abruptly from that point. On the other hand, the heat-transfer characteristic with condensation rise steeply with decrease of S/Hf and indicates slight peak at vicinity of 0.2 (S/Hf).

In view of these tendencies, it may be concluded that the smaller the value of S/Hf is, the more stable the heat-transfer characteristic is. On the other hand, one should recognize that the weight per unit length of the tube caused by increase in the number of grooves increases inversely proportional to the value of S/Hf. That is, when factors other than a number of the ridges to define the grooves are constant, decrease in the value of S/Hf implies increase in the number of the ridges and thus, in the weight per unit length on the tube, resulting in a high cost. Therefore, considering these factors overall, one should determine an optimum specification for the grooved tube.

Examples of the estimation to consider an overall merit in cost which is one of the objects of the present invention will be described below.

Figure 1A:
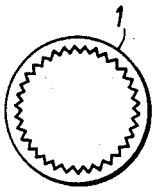
FIG. 1(a) PRIOR ART
Figure 1B:
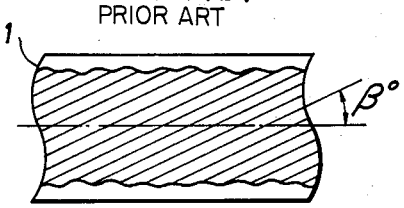
FIG. 1(b) PRIOR ART
Figure 2A:
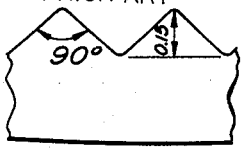
FIG. 2(a) PRIOR ART
Figure 2B:
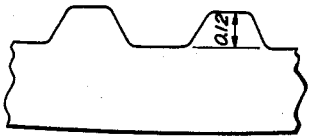
FIG. 2(b) PRIOR ART
Figure 2C:
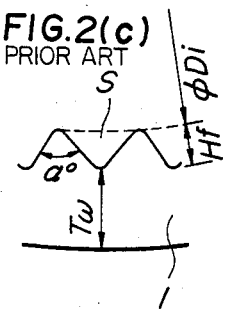
FIG. 2(c) PRIOR ART
Figure 11A:
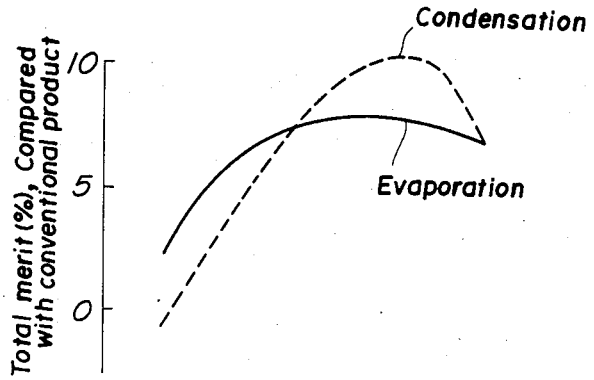

Supposing a fin-coil type heat exchanger of a room air conditioner which is one of typical heat exchangers, it has been assumed that the ratio of the outer thermal resistance of the tube including a slit type aluminum fin to the inner thermal resistance of a conventional tube used is 75%:25%. Then only the conventional tube shown in FIG. 2(*a*) was replaced by the grooved tube formed according to the present invention. The results obtained in this manner are shown in FIG. 11. FIG. 11(*b*) shows the relation between the rate of increase in heat-transit rate which was converted from the rate of increase in heat-transfer rate, and the value of S/Hf. Carrying out similar comparison on the weight per unit length of the tube, a graph shown in FIG. 11*a* is obtained. In this case, the conventional copper tube having an outside diameter of 9.52 mm, a groove depth of 0.15 mm, a helix angle ($\beta$) of 25°, a ridge apex angle of 90°, and a groove number of 65 was used.

Now, if the length of the tube was shortened by the increase in heat-transit rate, this increase results in the merit in cost. The amount of decrease in the weight per unit length results in the merit in cost close to the former.

Thus, the value of A+B becomes a total merit for a purchaser of the tube. Actually, the merit is decreased by attempting the improvements in capacity and/or efficiency of air conditioning, and if the workability of the tube is lowered, it further decreases. Therefore, the conversion into the merit in FIG. 11 is only a measure. However, as the examinations in the present invention were concentrated to the improvement in the characteristics as well as reduction of the weight per unit length of the tube, from this FIG. 11 it is understandable that satisfactory merit can be obtained even in the range which the value of S/Hf is lower and thus, the improvement in the characteristics is little.

The invention has been described in a preferred embodiment as being practiced with the inner surface grooved copper tube. As has already been mentioned, the present invention can achieve reduction in the weight per unit length, improvements in workability and characteristics of the tube by limiting the cross-sectional area of respective grooved section and the shape of the ridge defining the grooved section, and thus has great practical value.

Although the invention has been described with respect to a specific embodiment for complete and clear disclosure, the appended claims are not to be thus limited but are to be construed as embodying all modifications and alternative constructions that may occur to one skilled in the art which fall within the basic teaching herein set forth.

What is claimed is:

1. In a heat-transfer tube with a grooved inner surface adapted to phase-transition of fluid flowing inside the tube and having a number of spiral grooves having a helix angle ($\beta$) and ridges between said grooves having an apex angle formed on the inner surface of the tube, the ratio (Hf/Di) of the depth (Hf) of said grooves to the diameter (Di) of said inner surface of the tube being 0.02 to 0.03, and the helix angle ($\beta$) of said grooves to an axis of the tube being 7° to 30°, the improvements comprising:

each of said grooves being substantially trapezoidal in shape;

the ratio (S/Hf) of the cross-sectional area (S) of respective grooved section to said groove depth (Hf) ranging from 0.15 to 0.40;

each of said ridges being substantially triangular in cross-section; and the apex angle ($\alpha$) in cross-section of a ridge located between said respective grooves ranging from 30° to 60°.

2. A heat-transfer tube according to claim 1, wherein said grooves are formed at nearly equal intervals on the inner surface of the tube.

3. A heat-transfer tube according to claim 2 wherein said tube is made of copper.

* * * * *

REEXAMINATION CERTIFICATE (1256th)

United States Patent [19] [11] B1 4,658,892

Shinohara et al. [45] Certificate Issued Apr. 17, 1990

[54] HEAT-TRANSFER TUBES WITH GROOVED INNER SURFACE

[75] Inventors: Yoshihiro Shinohara; Kiyoshi Oizumi; Yasuhiko Itoh; Makoto Hori, all of Tsuchiura, Japan

[73] Assignee: Hitachi Cable, Ltd., Tokyo, Japan

Reexamination Request:
No. 90/001,636, Nov. 9, 1988

Reexamination Certificate for:

| | |
|---|---|
| Patent No.: | **4,658,892** |
| Issued: | **Apr. 21, 1987** |
| Appl. No.: | **684,622** |
| Filed: | **Dec. 21, 1984** |

[30] Foreign Application Priority Data

Dec. 28, 1983 [JP] Japan ..... 58-252191

[51] Int. Cl.[5] ..... F28F 1/40
[52] U.S. Cl. ..... 165/133; 165/184
[58] Field of Search ..... 165/133, 184

[56] References Cited

U.S. PATENT DOCUMENTS

| | | | |
|---|---|---|---|
| 2,279,548 | 4/1942 | Bailey | 165/133 |
| 3,779,312 | 12/1973 | Withers, Jr. et al. | 165/184 |
| 4,044,797 | 8/1977 | Fujie et al. | 165/184 |
| 4,118,944 | 10/1978 | Lord et al. | 165/133 |

FOREIGN PATENT DOCUMENTS

| | | | |
|---|---|---|---|
| 38663 | 3/1977 | Japan | 165/133 |
| 116765 | 9/1979 | Japan | 165/133 |
| 125563 | 9/1979 | Japan | 165/133 |
| 113988 | 9/1981 | Japan | 165/133 |
| 26394 | 2/1982 | Japan | 165/133 |
| 58088 | 4/1982 | Japan | 165/133 |
| 58094 | 4/1982 | Japan | 165/133 |
| 150799 | 9/1982 | Japan | 165/133 |

OTHER PUBLICATIONS

"Air Conditioner Refrigeration," by Yokoi (Apr. 1, 1983).

"Performance Characteristics of Multi-Grooved Tube," by S. Tojo (Nov., 1981).

*Primary Examiner*—Albert W. Davis, Jr.

[57] ABSTRACT

A heat-transfer tube with a grooved inner surface adapted to phase-transition for fluid flowing inside the tube disposed in a heat exchanger is disclosed. This tube can achieve the reduction in the weight per unit length, improvements in workability and characteristics of the tube by limiting the cross-sectional area of respective grooved section and the shape of the ridge defining the grooved section.

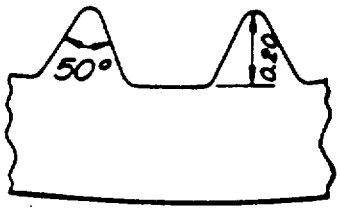

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 39–44:

The configurations or shapes of the conventional typical inner surface grooved tubes are shown in FIGS. [2(a) and 2(b)] *2(a), 2(b) and 2(c)*.

Figure 6A:
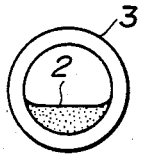
Figure 6B:
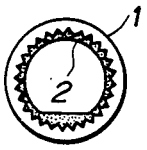

There conventional grooved tubes have a low ratio of the characteristics to the manufacturing cost due to the following two reasons:

Column 4, lines 11–57:

Next, considering the effects of the cross-sectional area (S) of the grooves on the heat-transfer characteristics, they include (1) the effect of stirring the fluid due to unevenness of the inner surface; (2) the effect of increase in inner surface area; and (3) the effect of variation in liquid film in the uneven portion. With respect to the stirring effect, there is no doubt that the depth of grooves (Hf) is dominant and the larger this is, the more this contributes to improvement in the heat-transfer characteristics. However, this closely relates to the effect of variation in liquid film. That is, when the fluid such as refrigerant flows at the velocity higher than a definite one, the liquid runs up in the spiral grooves due to a capillary action of the fine grooves and a drag force is caused by the velocity of the liquid and is liable to become a so-called annular flow to wet all of the inner periphery of the tube. This state is shown in FIGS. 6(a) and 6(b). FIG. 6(a) shows the state of a groove free tube in which the upper dried portion does not contribute to evaporation of liquid. FIG. 6(b) shows the state of a grooved tube in which the evaporation is enhanced by the entire inner periphery of the tube. However, even in such grooved tubes 1, when the cross-sectional area of the grooved section differs from one another and a total amount of liquid is constant, the thickness of liquid film differs from one another in its state as shown in FIG. 7. That is, in the tube (c) having a large cross-sectional area of the grooved section, the liquid film 2 is too thin, so that a tip of ridge projects from the film and thus does not bring about evaporation. On the other hand, in the tube (a) having a small cross-sectional area of the grooved section, the liquid film 2 is too thick, so that thermal resistance between a gas fluid and the tube wall increase resulting in poor heat-transfer characteristic. Therefore, in the tube (b) having and optimum cross-sectional area of the grooved section, the entire wall surface is covered with the liquid film as thin as possible. In this case, if the forms of the ridges separated by the grooves are the same, the inner surface area of the tube 1 is inversely proportional to the cross-sectional area of the grooves. Thus, considering the heat-transfer characteristics from this inner surface area, the tube (c) is inferior to the tube (b) and the tube (a) is superior to the tube (b). Therefore, it is contemplated that the overall optimum cross-sectional area S (exactly, S/Hf) exists between the [area (a) and the case (b)] *areas (a) and (c)* in FIG. 7.

Column 5, lines 59–69:

Supposing a fin-coil type heat exchanger of a room air conditioner which is one of typical heat exchangers, it has been assumed that the ratio of the outer thermal resistance of the tube including a slit type aluminum fin to the inner thermal resistance of a conventional tube used is 75%:25%. Then only the conventional tube shown in FIG. 2(a) was replaced by the grooved tube formed according to the present invention. The results obtained in this manner are shown in FIG. 11. FIG. [11(b)] *11(c)* shows the relation between the rate of increase in Column 6, lines 1–26: heat-transit rate which was converted from the rate of increase in heat-transfer rate, and the value of S/Hf. Carrying out similar comparison on the weight per unit length of the tube, a graph shown in FIG. [11a] *11(b)* is obtained. In this case, the conventional copper tube having an outside diameter of 9.52 mm, a groove depth of 0.15 mm, a helix angle ($\beta$) of 25°, a ridge apex angle of 90°, and a groove number of 65 was used.

Now, if the length of the tube was shortened by the increase in heat-transit rate, this increase results in the merit in cost. The amount of decrease in the weight per unit length results in the merit in cost close to the former.

Figure 11B:
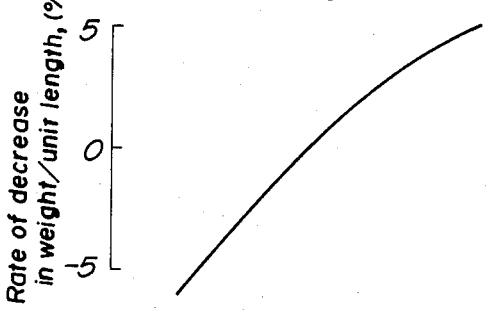
Figure 11C:
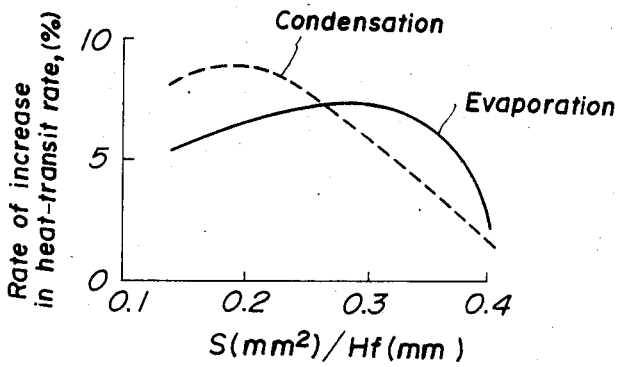

Thus, the value of [A+B] *the addition of FIGS. 11(b) and 11(c)* becomes a total merit for a purchaser of the tube. Actually, the merit is decreased by attempting the improvements in capacity and/or efficiency of air conditioning, and if the workability of the tube is lowered, it further decreases. Therefore, the conversion into the merit in FIG. 11 is only a measure. However, as the examinations in the present invention were concentrated to the improvement in the characteristics as well as reduction of the weight per unit length of the tube, from this FIG. 11 it is understandable that satisfactory merit can be obtained even in the range which the value of S/Hf is lower and thus, the improvement in the characteristics is little.

The drawing figure(s) have been changed as follows: In FIG. 5, the legend Apex has been changed to Helix. In FIG. 11a, the lead lines for the legends have been reversed.

AS A RESULT OF REEXAMINATION, IT HAS BEEN DETERMINED THAT:

Claim 1 is determined to be patentable as amended.

Claims 2 and 3, dependent on an amended claim, are determined to be patentable.

New claims 4 and 5 are added and determined to be patentable.

1. In a heat-transfer tube with a grooved inner surface adapted to phase-transition of fluid flowing inside the tube and having a number of special grooves having a helix angle ($\beta$) and ridges between said grooves having an apex angle formed on the inner surface of the tube, the ratio (Hf/Di) of the depth (Hf) of said grooves to the diameter (Di) of said inner surface of the tube being 0.02 to 0.03, and the helix angle ($\beta$) of said grooves to an axis of the tube being 7° to 30°, the improvements comprising:

each of said grooves being substantially trapezoidal in shape;

the ratio (S/Hf) of the cross-sectional area (S) of respective grooved section to said groove depth (Hf) ranging from [0.15 to 0.40] *0.22 to 0.33;* each of said ridges being substantially triangular in cross-section; and the apex angle ($\alpha$) in cross-section of a ridge located between said respective grooves ranging from 30° to 60°.

*4. A heat-transfer tube according to claim 1, wherein the ratio of the heat-transfer rate of said tube is at least 2.65 times greater than the heat-transfer rate of a groove-free tube when said tube is used for evaporation.*

*5. A heat-transfer tube according to claim 1, wherein the ratio of the heat-transfer rate of said tube to the heat-transfer rate of a groove-free tube is substantially equal to 2.70.*

* * * * *